United States Patent [19]

Stewart

[11] 4,125,075

[45] Nov. 14, 1978

[54] HIGH SPEED PRODUCTION TAMPER COMPACTOR

[75] Inventor: John K. Stewart, Lexington, S.C.

[73] Assignee: Canron, Inc., New York, N.Y.

[21] Appl. No.: 779,227

[22] Filed: Mar. 18, 1977

[51] Int. Cl.[2] ..... E01B 27/17

[52] U.S. Cl. ..... 104/7 B; 104/7 R; 104/8; 104/12

[58] Field of Search ..... 104/7 R, 7 B, 8, 10, 104/12, 13, 14

[56] References Cited

U.S. PATENT DOCUMENTS

| | | | |
|---|---|---|---|
| 3,545,384 | 12/1970 | Plasser et al. | 104/12 X |
| 3,589,296 | 6/1971 | Plasser et al. | 104/12 |
| 3,610,157 | 10/1971 | Plokhotsky et al. | 104/12 |
| 3,638,578 | 2/1972 | Helgemeir | 104/12 |
| 3,731,409 | 5/1973 | Schenkir et al. | 104/12 X |
| 3,811,382 | 5/1974 | Buchter et al. | 104/12 X |
| 3,926,123 | 12/1975 | Plasser et al. | 104/12 X |
| 3,965,822 | 6/1976 | Stewart | 104/12 X |

FOREIGN PATENT DOCUMENTS

| | | | |
|---|---|---|---|
| 2,005,452 | 12/1969 | France | 104/2 |

*Primary Examiner*—Randolph A. Reese

[57] ABSTRACT

The invention relates to a process and apparatus for correcting the surface of a railroad track by exerting pressure on the shoulders of the track from both sides thereof by means of vibrating compactors mounted on a vehicle chassis and provided with pressure applying jacks. The ballast is compacted beneath the track which raises it to a desired first track level which may be above the final desired track level, whereafter the track is tamped down to the desired level by means of a force applicator which imparts pulsating force to depress the raised track.

11 Claims, 7 Drawing Figures

HIGH SPEED PRODUCTION TAMPER COMPACTOR

BACKGROUND OF THE INVENTION

The invention relates to the process and apparatus for reconstituting the structure and the surface of a railroad track.

In U.S. Pat. No. 3,811,382, Buchter et al, issued May 21, 1974, there is described a track correcting machine and process in which the track is raised and ballast is compacted under the track by means of a plow. The track is then tamped down to the desired correct position by means of a rail engaging tamping tool which imparts a downwardly directed pulsating force to tamp the track down to the correct level. Both plow and tamping device are interrelated by means of a reference system to control operation of the plow and the tamping means to produce between the operation of the two the correct final track condition.

One of the problems with using a plow type device for pushing ballast beneath the track is that, it generally requires that the plow share be inserted between ballast and tie end, thereby separating the track panel from the supporting ballast.

The present invention seeks to provide a process and device in which it is not necessary to completely separate the track panel clear of the ballast thus permitting the entire track structure to be treated as a unit.

SUMMARY OF THE INVENTION

According to the present invention, there is provided a process for reconstituting the structure and surface of a railroad track by continuously exerting pressure on the shoulders of the track, substantially transversely thereof, to a degree sufficient to displace the ballast beneath the track to raise it to a desired first level.

Preferrably, the first level is above a desired final level and the process provides that after displacing the ballast, a downwardly directed pulsating force is imparted to the track to tamp the track down to the desired final level.

According to a feature of the invention, the pressure may be exerted on the shoulders of the track in an unbalanced fashion to provide an aligning force component, whereby to align the track to a desired position. This alignment of the track is a feature which is very difficult, if not impossible, with a plow type device.

Preferably a vibratory force is imparted at the point of, and during, the application of pressure.

The process also preferably comprises the first step of plowing the ballast shoulders to a desired configuration, say 20° from the horizontal.

The present invention also provides apparatus for reconstituting the structure and surface of railroad track comprising a track maintenance vehicle; compacting means mounted on the vehicle for continuously exerting an inwardly directed pressure on each of the shoulders of the track substantially transversely, and from opposite sides, thereof to displace the track and raise and align the track. In a preferred embodiment the apparatus further comprises means mounted on the vehicle, behind the compacting means, for imparting a downwardly directed pulsating force to depress the track.

In a preferred embodiment of the invention, a ballast distribution plow means may be mounted on the vehicle chassis on the front thereof, and indeed a ballast shoulder contour plow means may be mounted on the rear of the chassis.

DESCRIPTION OF THE DRAWINGS

The following is a description, by way of example, of certain embodiments of the present invention, reference being had to the accompanying drawings in which.

DESCRIPTION OF THE PREFERRED EMBODIMENT

Figure 1:
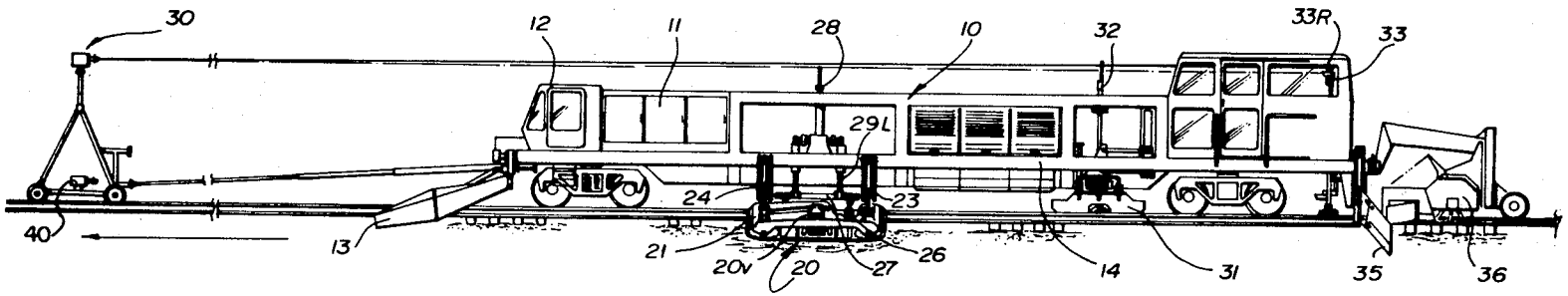
FIG. 1, is a diagrammatic side elevation of a machine for track correction.

The track maintenance machine 10 is self-propelled and is provided with its own prime mover 11 controlled by a crew man in a front cab 12. The front plow 13 is mounted on the chassis 14 of the machine 10 and, as the machine proceeds in the direction of travel as indicated by the arrow, the plow 13 arranges the ballast for the subsequent compacting operation. The preferred arrangement of the ballast at the shoulders is about 20° from the horizontal. Track compacting means 20 are mounted on the chassis 14 and have a vibrating means 20V mounted thereon. The orientation of the endless track 21 and the continuous pressure of that endless track against the ballast to perform a lifting and aligning operation is accomplished by hydraulic jacks, known in the art, two of which are shown at 23 and 24. Optionally, rail gripping rollers 26 may be provided on a frame 27; track lifting jacks 29L connect the frame 27 to the chassis 14. Where provided, the rail gripping rollers 26 and the track lifting jacks 29L may be used to assist the continuous track compacting and aligning operation of the endless tracks. Other types of compactors will be described hereinafter. The endless track 21 is mounted at its center to the chassis 14 by a pivotal connection (not shown) so as to provide three dimenssional freedom. It, thus, can be oriented, with respect to the chassis 14, so that the angle of contact of the endless track 21 with the ballast shoulders may be varied in a roll, yaw, or pitch planes. That is to say, the endless track 21 can be rotated about an axis parallel to the railroad track to accommodate for the variations in the angle of the track shoulder, and can also be controlled so that the leading edge of the endless track can be closer to the tie ends than the trailing edge, or vice-versa. In the embodiment shown in FIG. 1, the compacting means comprises a pair of endless tracks 21 mounted opposite each other, one on either side of the machine.

In operation, force is continuously applied by the vibrating compacting means 20 to the shoulders of the track from either side as the machine moves along the track and, as pressure is exerted on the ballast beneath the track, the ballast is squeezed, raising the track. As the track is raised, a shadow board 28 of a standard light beam reference system 30 is raised therewith and intersects the light beam to terminate the pressure application to the ballast shoulders. The reference system 30 may be set so that the quantity of light received at the receiver 33 over the shadow board 28 is proportional to the size of the track surface error and the receiver may, in conventional fashion, send a command signal to the hydraulic jacks 23, 24 to control the orientation of the endless track 21 and the amount of pressure applied in order to effect reconstitution of the track structure and surface. The ballast is thus displaced beneath the ties so that when the shadow board is raised with the rails and intersects the beam, the track has been raised by displacement of the ballast to a desired first height. This first height, or level, will in many cases be above the actual final height which is desired.

To control the transverse alignment of the track, an alignment reference system may be provided. This system may take any suitable form and is inferentially depicted in FIG. 1 by the light beam transmitter 40 on the front car of the reference system.

A shadow board (not shown) would be mounted in the vicinity of the compactor means 20 and a receiver at the rear of the machine. Where the receiver detects track mis-alignment, it transmits an aligning signal to the control jacks 23 and 24 on either side of the track to perform an aligning operation. This can be accomplished by altering the angles at which the endless tracks engage the shoulder ballast, for example, by toeing-in one endless track and heeling-in its companion on the other side of the track to produce a shaping of the ballast to align the track horizontally by pressure.

As the machine proceeds in the direction of the arrow, a tamping device 31 which runs on the rails of the track on an antifriction surface may be operated, if the initial track raising step lifted the track above the final desired height, to impart a pulsating downwardly directing pounding force to the track through the rails. This force is applied until a second shadow board 32 of the light beam reference system 30 indicates, by means of the light beam receivers 33R, that the track has been tamped down to its desired final level.

Mounted on the chassis 14 at the rear of the machine is a shoulder dressing plow 35 which dresses the shoulders of the ballast, and trailing the machine is a track broom 36 which cleans the track.

The shadow boards 28 and 30 may, if desired, be arranged with a control system such as that shown in U.S. Pat. No. 3,811,382 so as to control operation of the compactor 20 and the tamping head 31.

Other forms of compacting means are shown in FIGS. 2 through 7.

Figure 2:
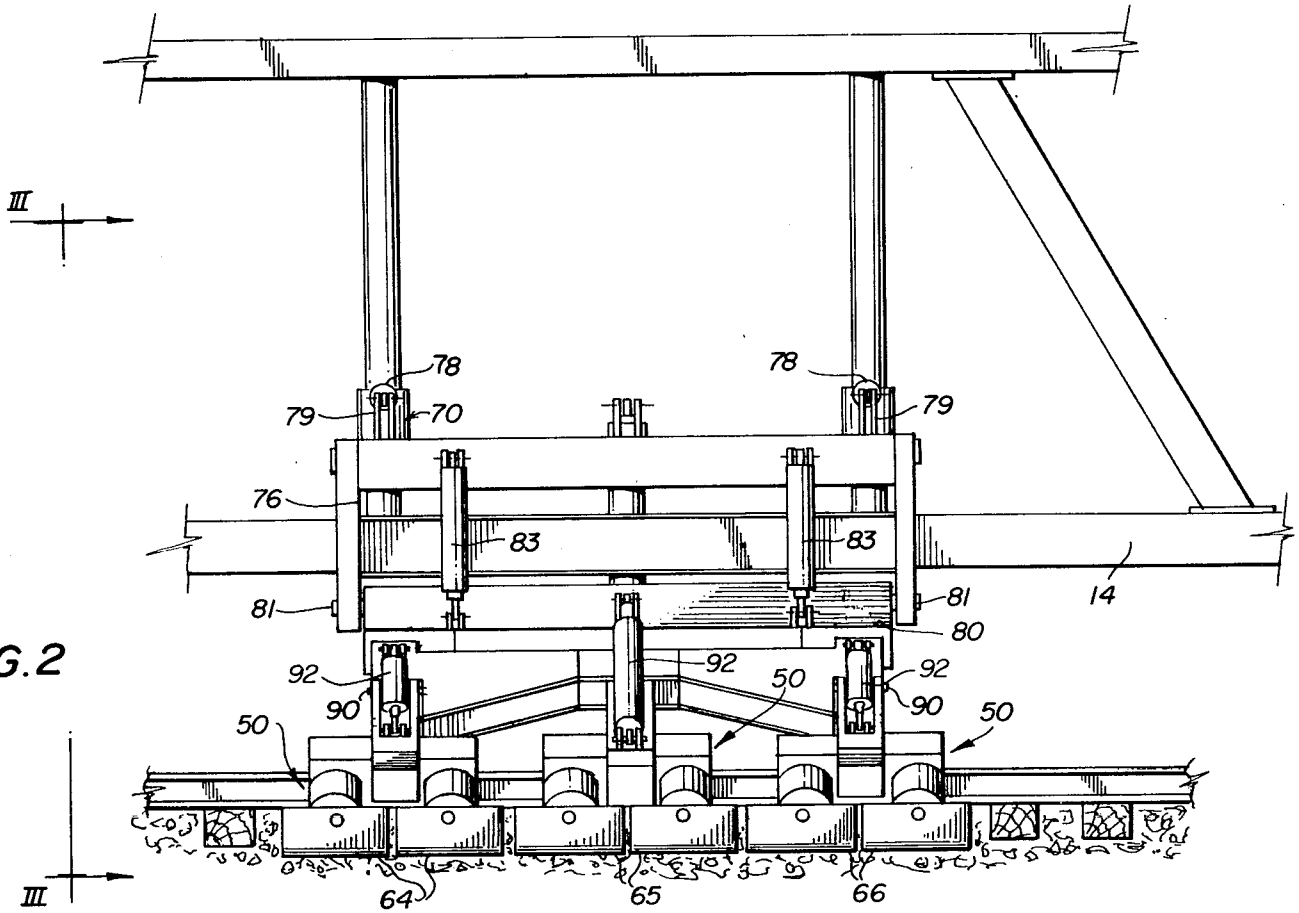
FIG. 2 is a detail in side elevation of an alternative form of vibratory compactor.
Figure 3:
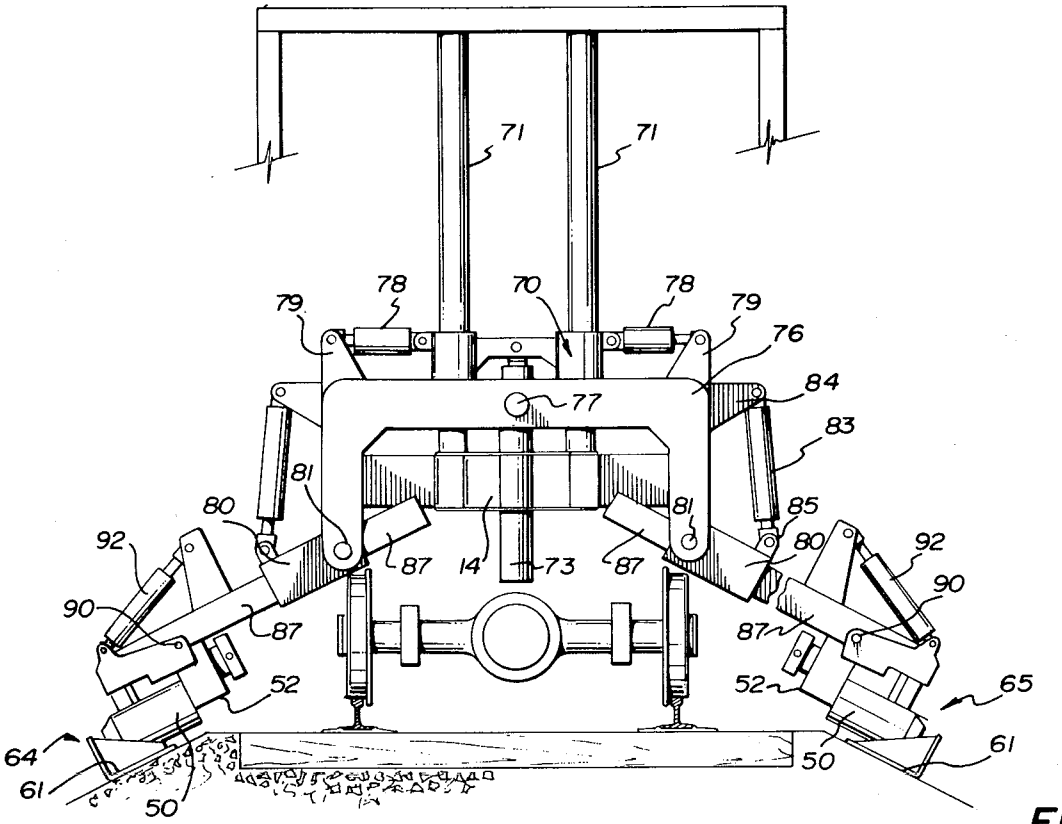
FIG. 3, is a detail of the compactor shown in the FIG. 2 but in end elevation looking in the direction of the arrows III, III in FIG. 2.
Figure 4:
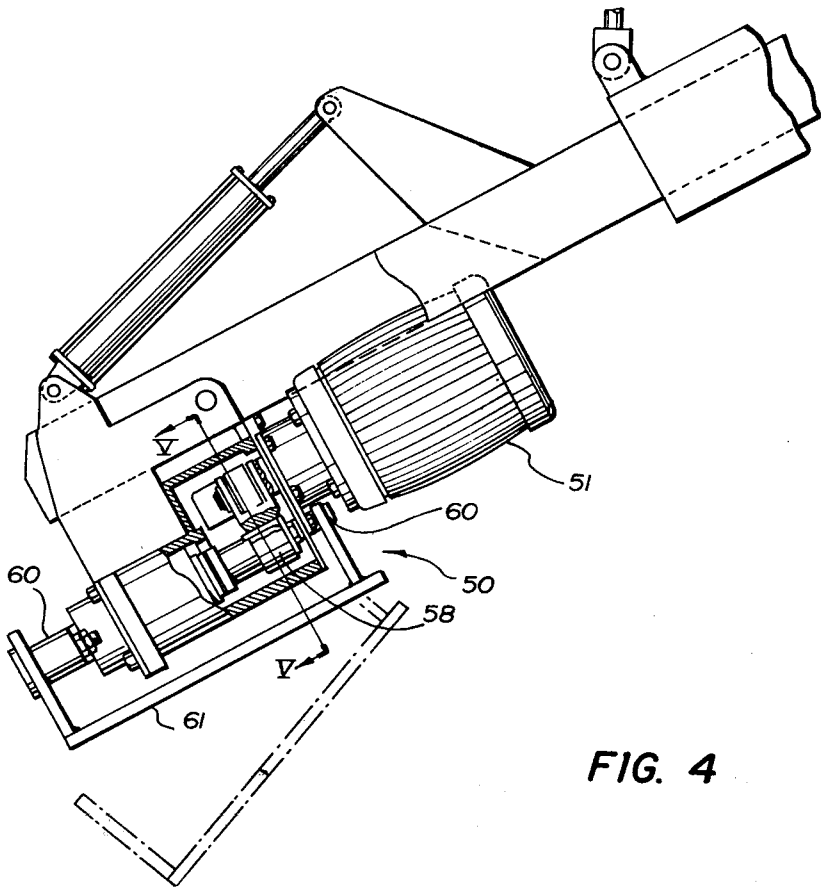
FIG. 4, is a detail of a modified vibratory compactor unit similar to that seen in FIG. 3 and looking in the same direction, the vibrator construction being partially in the section.

Referring now particularly to FIGS. 2 through 5, a positive amplitude vibrator 50 may form the basic unit of the compactor 20. This type of positive amplitude vibrator is well known in the art, and has been in the past used in tamping heads. An example of this type used is found in U.S. Pat. No. 3,177,813. Since the operation of such positive amplitude vibrators is well known, it will not be discussed in detail, but as seen in FIGS. 4 or 3, an electric motor 51 (or a hydraulic motor 52) drives a central shaft 54 (see FIG. 5) to displace crank and connecting rods 57, 58 to oscillate shafts 60. As will be seen in FIG. 4, paddles 61 are attached to the oscillating shaft 60 at both ends. It will be noted that in the embodiment shown in FIG. 3, the paddles 61 are attached to the outer end of the shaft 60. The paddles are thus oscillated in a clockwise and counter clockwise direction about the shaft 60 to create the vibration for the compactor. When applied to the shoulder ballast, and with the machine moving forward, oscillating motion of the paddles tends to produce a "walking action" along the shoulders of the ballast. As will be seen in FIG. 2, the vibrators 50 are mounted in pairs of two, to provide leading, center and trailing groups of pairs 64, 65, 66.

Referring now to FIGS. 2 and 3, the main frame 14 of the machine 10 carries a work frame generally indicated with the reference numeral 70. The work frame is slidable on lift guides 71 and is vertically movable on the frame 14 by lift cylinders 73.

Mounted on the work frame 70 is a cross level frame 76. The cross level frame 76 is pivotally mounted by pivots 77 to the main frame 70 and is pivoted thereon by means of cross level cylinders 78 which operate between the main frame 70 and brackets 79 on the cross level frame 76. A pivot frame 80 is provided on each side and is pivoted in pivots 81 to the cross level frame 76. Pivoting of the frames 80 is by means of workhead pivot cylinders 83 acting between brackets 84 and 85.

Telescopically mounted within the pivot frame 80 is a workhead frame 87. The frames 87 have telescoping cylinders within them which are not shown in FIGS. 2 or 3. Mounted on the workhead frame are the pairs of vibrators 64, 65, 66. The pairs of vibrators are pivotally mounted on pivot 90 on the telescopic workhead frame and pivoted by the action of aligning cylinders 92.

As with the embodiment of FIG. 1, the compactors comprising the pairs of vibrators 64, 65, and 66 continuously move along the shoulder ballast and by telescoping the frames 87 relative to the frame 80 the width of the shoulder ballast can be accommodated. All three pairs of vibrators work together under the action of the workhead pivot cylinders 83 to compact the ballast to lift the track. Additionally, where an aligning operation is required, one or more of the cylinders 92 may be operated individually or together on one side of the machine to increase the horizontal force exerted by individual pairs, usually the center pair 65, of vibrators. The trailing pair of vibrators 66 provide a finishing action to the shoulder of the ballast.

Figure 5:
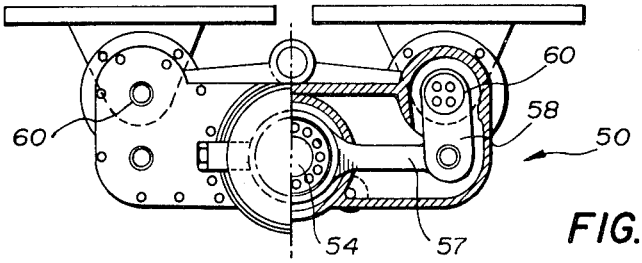
FIG. 5 is a detail partially in section along line V, V of FIG. 4.
Figure 6:
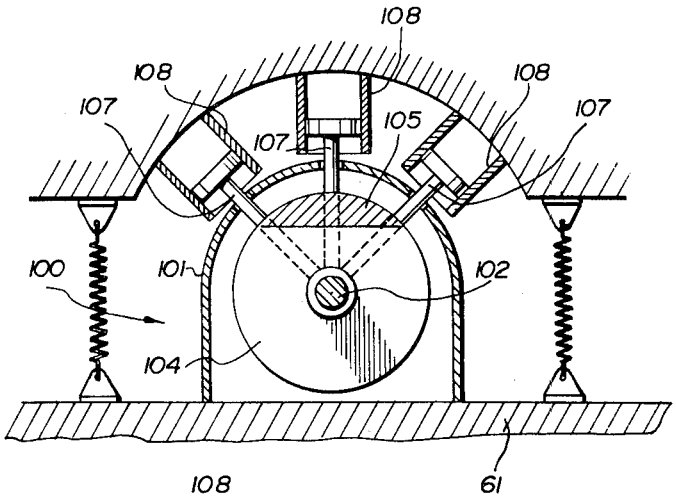
FIG. 6, is a schematic detail of a further type of vibratory compactor.
Figure 7:
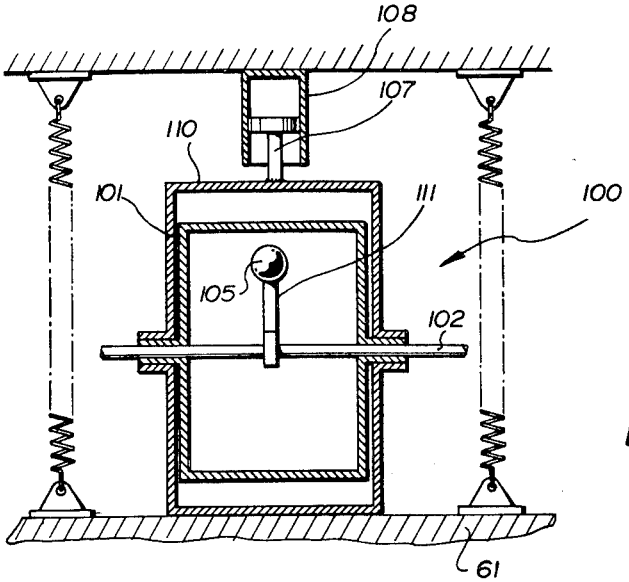
FIG. 7, is a schematic end view, in section, of the compactor shown in FIG. 6.

Referring now to FIGS. 6 and 7, two alternative, but similar, types of vibrator 100 are shown to take the place of positive amplitude vibrators of FIG. 5. Here the paddle 61 is spring mounted to a frame such as the telescopic frame 87. In FIG. 6 a housing 101 is mounted on the paddle 61 and carries a shaft 102 on which is mounted a disc 104 having an out-of-balance weight 105. Piston rods 107 connected to the shaft 102 protrude into cylinders 108. As the weight 105 is rotating at the top part of its travel, that is to say, is tending to lift paddle 61 from engagement with the ballast, the upward component of motion is stored in the cylinders 108. As the weight 105, on the disc 104, continues to revolve the stored energy is returned to the vibrator through the shafts 107.

The device of FIG. 7 is similar to FIG. 6, but here the cylinders 108 are mounted on an outer casing 110 which can be rotated relative to the casing 101, which is now an inner casing. In this configuration, the piston rod 107 is attached to the outer casing 101 rather than to the shaft 102, and for the sake of simplicity the disc 104 and weight 105 have been shown as a weight mounted on a shaft 111. Provision, not shown, is made for rotating the outer casing 110 about the shaft so as to alter the position of the cylinder, or cylinders, 108. In this fashion control is exercised over the direction in which the stored energy in cylinder 108 is stored and applied to the paddle 61.

It will be understood that other forms of vibrators could be used and that other forms of mountings could be provided for them, the essential requirement being that the compactor as a whole be mounted on the main frame 14 of the machine so that its compacting action can be controlled to direct the forces exerted by the compactor to lift and align the track as the compactor moves continuously along the track.

A further example of such other form of vibrator could be where casing 110 is formed as a stirrup to support shaft 102 and terminates at the bearing, the inner casing 101 being extended into contact with paddle 61.

Although the compacting means and the means for directing the downwardly direct pulsating force has hereinbefore been shown on a single common frame, it is to be understood, that these devices could be independently mounted on separate frames.

What is claimed as my invention is:

1. A process for reconstituting the structure and the surface of a railroad track by exerting pressure continuously adjacent the ends of the ties, substantially transversely thereof, to a degree sufficient to displace the ballast beneath the track, the ballast displacement being substantially the sole means to raise the track to a first level and align the track.

2. A process as claimed in claim 1 in which in the alignment of the track the pressure exerted on the track is unbalanced to provide an aligning force component whereby to align the track to a desired position.

3. A process for reconstituting the structure and the surface of a railroad track by exerting pressure continuously on the shoulders of the track substantially transversely thereof, to a degree sufficient to displace the ballast beneath the track, the ballast displacement being substantially the sole means to raise the track to a first level and to align the track.

4. A process as claimed in claim 3 in which in the alignment of the track the pressure exerted on the shoulders of the track is unbalanced to provide an aligning force component whereby to align the track to a desired position.

5. A process as claimed in claim 3 including imparting a vibratory force at the point of, and during, the application of pressure.

6. Apparatus for reconstituting the structure and the surface of a railroad track comprising a track maintenance vehicle having a frame; compacting means mounted on the vehicle; pressure exerting means mounted between said frame and said compacting means for exerting through the compacting means a continuous inwardly directed pressure independently on each side of the track adjacent the tie ends substantially transversely and from opposite sides of the track, whereby to displace the ballast and raise and horizontally align the track.

7. Apparatus for reconstituting the structure and the surface of a railroad track comprising a track maintenance vehicle having a frame; compacting means mounted on the vehicle, pressure exerting means mounted between said frame and said compacting means for exerting through the compacting means a continuous inwardly directed pressure independently on each of the shoulders of the track substantially transversely, and from opposite sides thereof, whereby to displace the ballast and raise and horizontally align the track.

8. Apparatus as claimed in claim 7 in which vibrating means is mounted on at least one of said compacting means.

9. Apparatus as claimed in claim 7 in which said compacting means includes an endless track and pressure applying jacks means mounted between said endless track and a chassis of said vehicle.

10. Apparatus as claimed in claim 7 in which the compacting means comprises a battery of vibrators arranged in pairs and articulated to the chassis of the vehicle.

11. Apparatus as claimed in claim 10 in which individual pairs of vibrators of the battery are pivotally mounted on a workhead frame which is itself articulated to the chassis of the vehicle, and means is provided to individually pivot each pair of vibrators relative to the workhead frame.

* * * * *